US008727852B1

(12) United States Patent
Palihapitiya et al.

(10) Patent No.: US 8,727,852 B1
(45) Date of Patent: May 20, 2014

(54) OPEN FACE POKER CARD GAME

(71) Applicant: Project Pineapple, LLC, Palo Alto, CA (US)

(72) Inventors: Chamath Palihapitiya, Menlo Park, CA (US); Diego Berdakin, Los Angeles, CA (US)

(73) Assignee: Project Pineapple, LLC, Palo Alto, CA (US)

( * ) Notice: Subject to any disclaimer, the term of this patent is extended or adjusted under 35 U.S.C. 154(b) by 0 days.

(21) Appl. No.: 14/069,976

(22) Filed: Nov. 1, 2013

(51) Int. Cl.
*G07F 17/32* (2006.01)

(52) U.S. Cl.
CPC ..... *G07F 17/3293* (2013.01); *G07F 17/3276* (2013.01); *G07F 17/32* (2013.01)
USPC ..... 463/13; 463/16; 463/25

(58) Field of Classification Search
CPC . G07F 17/32; G07F 17/3272; G07F 17/3276; G07F 17/3293; G07F 17/3267
USPC ..... 463/12–13, 16–20, 25
See application file for complete search history.

(56) References Cited

U.S. PATENT DOCUMENTS

| | | | | |
|---|---|---|---|---|
| 5,294,128 | A | 3/1994 | Marquez | |
| 5,833,536 | A * | 11/1998 | Davids et al. | 463/11 |
| 6,098,984 | A * | 8/2000 | Moore, Jr. | 273/292 |
| 6,155,568 | A | 12/2000 | Franklin | |
| 6,443,455 | B1 * | 9/2002 | Webb | 273/274 |
| 6,474,646 | B1 | 11/2002 | Webb | |
| 6,793,220 | B1 | 9/2004 | Feola | |
| 7,455,297 | B2 | 11/2008 | Tang | |
| 8,177,616 | B2 | 5/2012 | Nicely | |
| 8,398,083 | B2 | 3/2013 | Costa | |
| 2004/0127274 | A1 | 7/2004 | Franklin | |
| 2007/0126181 | A1 * | 6/2007 | Ciaffone | 273/292 |
| 2008/0191417 | A1 * | 8/2008 | Pham | 273/292 |
| 2011/0084449 | A1 | 4/2011 | Poon | |
| 2012/0061915 | A1 | 3/2012 | Snow | |

* cited by examiner

*Primary Examiner* — Arthur O Hall
*Assistant Examiner* — Jasson Yoo

(57) ABSTRACT

A programmed computer for executing a poker game including transmitting draws of cards to players; receiving from each player a location of each card from the draws in one of three rows for each player, the first row holding a maximum of three cards, and the second and third rows each holding a maximum of five cards; displaying the cards from the draws such that the suit and rank of cards and card locations for one player are visible to another player; comparing the corresponding rows of each player and generating a score for each player; and determining whether any player is eligible for bonus treatment in the following round.

11 Claims, 8 Drawing Sheets

Fig. 6

Royalties

| Hand | Front Row Points | Middle Row Points | Back Row Points |
|---|---|---|---|
| Pair of 6s | 1 | | |
| 7s | 2 | | |
| 8s | 3 | | |
| 9s | 4 | | |
| 10s | 5 | | |
| Jacks | 6 | | |
| Queens | 7 | | |
| Kings | 8 | | |
| Aces | 9 | | |
| Three 2s | 20 | 2 | |
| 3s | 20 | 2 | |
| 4s | 20 | 2 | |
| 5s | 20 | 2 | |
| 6s | 20 | 2 | |
| 7s | 20 | 2 | |
| 8s | 20 | 2 | |
| 9s | 20 | 2 | |
| 10s | 20 | 2 | |
| Jacks | 20 | 2 | |
| Queens | 20 | 2 | |
| Kings | 20 | 2 | |
| Aces | 20 | 2 | |
| Straight | | 4 | 2 |
| Flush | | 8 | 4 |
| Full House | | 12 | 6 |
| Quads | | 20 | 10 |
| Straight Flush | | 30 | 15 |
| Royal Flush | | 50 | 25 |

OPEN FACE POKER CARD GAME

BACKGROUND OF THE INVENTION

In recent years, poker has become increasingly popular, and numerous variations of poker exist, including Five Card Draw, Three-card Poker, Five Card Stud, Seven Card Stud, Hold'em (also called Texas Hold'em), Omaha (also called Omaha Hold'em), and Pai-Gow Poker. The variations in these games generally relate to the manner in which cards are dealt and played and in the manner and frequency in which bets are placed. In Chinese Poker, each player receives a 13 card hand from a standard 52 card deck. Each player must divide those cards into three hands: a "front hand" containing three cards, a "middle hand" containing five cards, and a "back hand" containing five cards. The "back hand" must be the highest ranking hand, and the "front hand" must be the lowest ranking hand. After each player has received and arranged the cards into three hands, corresponding hands are compared and scored. For example, Players 1's "back hand" is compared to Player 2's "back hand" using standard poker rules. The player with the higher ranking hand receives points that may translate into winnings. An open-face variation to Chinese poker is described herein.

SUMMARY OF THE INVENTION

A programmed computer for executing a poker game including memory having at least one region for storing computer executable program code; and processor executing the program code stored in the memory, wherein the program code includes a) transmitting a first draw of a predetermined number of cards to two or more players such that the suit and rank of cards for one player are not visible to another player; b) receiving from each player a location of each card from the first draw in one of three rows for each player, the first row holding a maximum of three cards, and the second and third rows each holding a maximum of five cards; c) displaying the cards from the first draw such that the suit and rank of cards and card locations for one player are visible to another player; d) transmitting a second draw of a predetermined number of cards to the two or more players such that the suit and rank of cards for one player are not visible to another player; e) receiving from each player a discarded card from the second draw and receiving from each player the location of each remaining card from the second draw in one of the three rows; f) displaying the cards from the second draw such that the suit and rank of cards and card locations for one player are visible to another player; g) repeating steps d), e), and f) for third, fourth, and fifth draws; h) comparing the corresponding rows of each player and generating a score for each player; and i) determining whether any player is eligible for bonus treatment in the following round.

BRIEF DESCRIPTION OF THE DRAWINGS

FIG. 6 is a table showing the scoring and royalty models of an aspect of Open Face Poker Variation according to the system and method of the present disclosure.

DETAILED DESCRIPTION OF THE DRAWINGS

Figure 1:
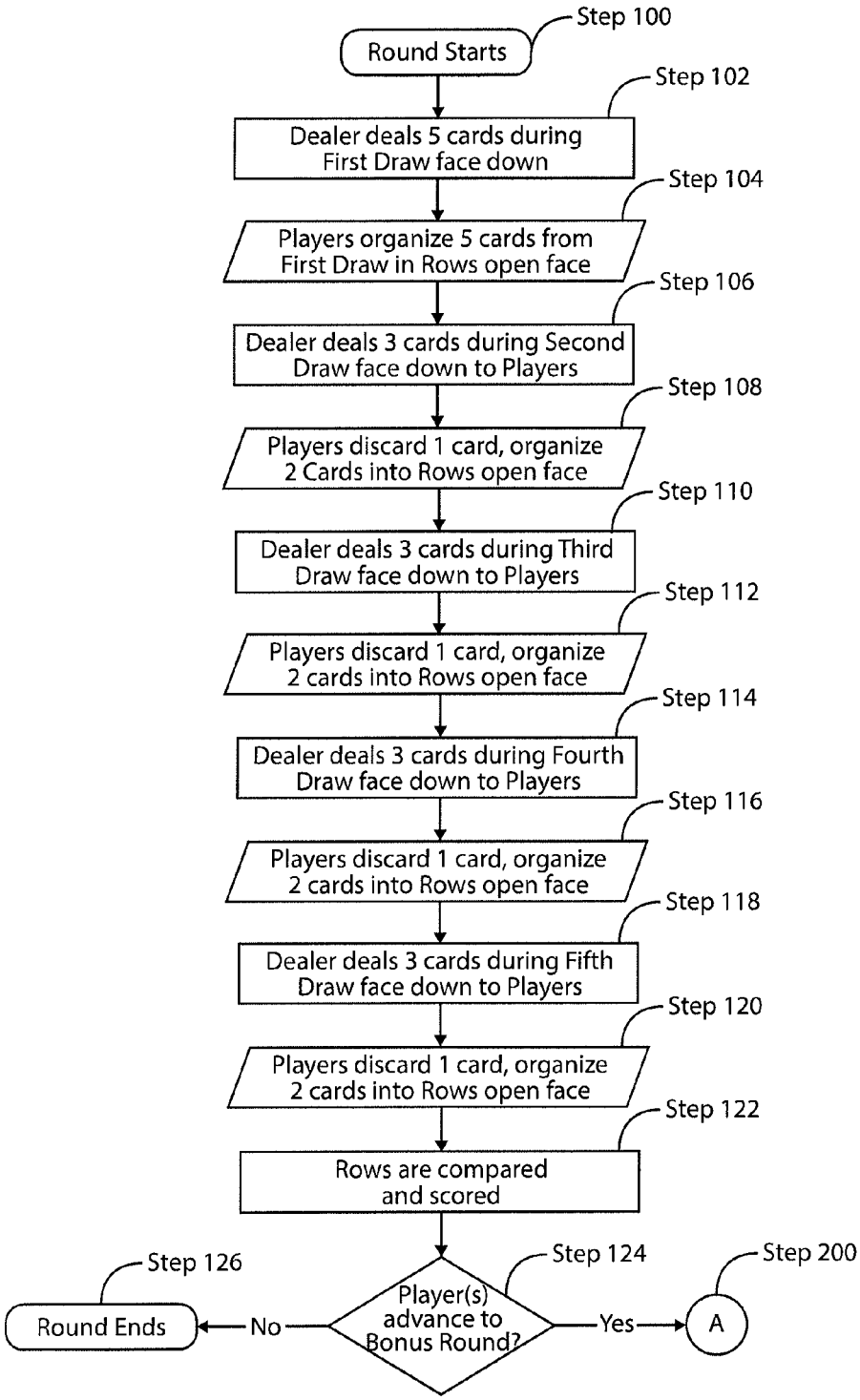
FIG. 1 is a process flow describing a round of the Open Face Poker Variation according to the system and method of the present disclosure.

FIG. 1 is a process flow describing a round of the Open Face Poker Variation according to the system and method of the present disclosure. As a part of the description of FIG. 1, references will be made to the elements in FIG. 2. In Step 100, the round begins. In Step 102, Dealer 4 distributes the First Draw to all participating players. As a part of the First Draw, Dealer 4 may distribute five cards to each player (e.g. five cards to Player 1, five cards to Player 2, five cards to Player 3). The cards may be distributed one-by-one to each player face down, until each player has five cards. In Step 104, once each player has five cards, the players may organize their five cards open face in any of the three rows (e.g. Front Row 16, Middle Row 17, Back Row 18). The player to the left of Dealer Button 36 organizes their five cards first, followed by the player directly to their left. The players are free to organize their five cards within any row of their Hand 14 (e.g. all five cards in Back Row 18), so long as there are no more than three cards in Front Row 16 and no more than five cards in each of the Middle Row 17 and Back Row 18.

During Step 106 Dealer 4 deals the Second Draw to all players. The Second Draw consists of three cards dealt to each player face down, with cards dealt one at a time to each player, starting with the player directly to the left of Dealer Button 36. During Step 108, once all players have received three cards face down, each player organizes two of the three cards in any row open face. In contrast to the organization of cards that takes place in Step 104, in Step 108 each player must discard one of the three cards dealt to them during Step 106. Starting with the player directly to the left of Dealer Button 36 and moving on to the next player when they have finished organizing their cards, each player places one card from the Second Draw within Discard Pile 13 face down, so the other players do not see the value or suit of the discarded card. At this point, each player has seven cards within their Hand 14, (five cards from the First Draw+two cards from the Second Draw) that are distributed in any of the player's three rows.

In Step 110, Dealer 4 deals the Third Draw to all players. All players receive three cards face down. At Step 112, the players then place one of the three cards face down within Discard Pile 13, so the other players do not see the value or suit of the discard card, and organize the other two cards within any row open face. At this point, each player has nine cards within their Hand 14, (five cards from the First Draw+two cards from the Second Draw+two cards from Third Draw) that are distributed in any of the player's three rows.

In Step 114 Dealer 4 deals the Fourth Draw to all players. All players receive three cards face down. At Step 116 the players then place one of the three cards face down within Discard Pile 13, so the other players do not see the value or suit of the discard card and organize the other two cards within any row open face. At this point, each player has 11 cards within their Hand 14, (five cards from the First Draw+two cards from Second Draw+two cards from the Third Draw+two cards from the Fourth Draw) that are distributed in any of the player's three rows.

In Step 118, Dealer 4 deals the Fifth Draw to all players. All players receive three cards face down. At Step 120, the players then place one of the three cards face down within Discard Pile 13, so the other players do not see the value or suit of the discard card, and organize the other two cards within any row open face. At this point, each player has 13 cards within their Hand 14, (five cards from the First Draw+two cards from the Second Draw+two cards from the Third Draw+two cards from the Fourth Draw+two cards from the Fifth Draw) that are distributed in any of the player's rows.

After the Fifth Draw, each player will have a completed Hand 14 (e.g. three cards in Front Row, five cards in Middle Row, five cards in the Back Row). During Step 122, once each player has a completed Hand 14, the players and/or Dealer 4 compare the rank of corresponding rows for each player (e.g. Player 1's Front Row vs. Player 2's Front Row, Player 1's Front Row vs. Player 3's Front Row, Player 2's Front Row vs. Player 3's Front Row, Player 1's Middle Row vs. Player 2's Middle Row, Player Middle Row vs. Player 3's Middle Row, Player 2's Middle Row vs. Player 3's Middle Row, Player 1's Back Row vs. Player 2's Back Row, Player 1's Back Row vs. Player 3's Back Row, Player 2's Back Row vs. Player 3's Back Row). The winner of each head-to-head row comparison wins points, as well as any royalties for a certain rank of row (e.g. Player 1 gets X points for Front Row beating Player 2's Front Row).

During Step 124, it is determined whether any of the players participating in Open Face Poker Variation will enter the Bonus Round when the next round begins. A Bonus Round is a variation of Open Face Poker Variation that is played by players that achieve a certain row ranking or better during a round of Open Face Poker Variation or a Bonus Round. In one non-limiting example, to participate in a Bonus Round, a player must have a pair of Queens or better in the Front Row 16 during a standard round without fouling their Hand 14. If one or more players have a pair of Queens or better in the Front Row 14 without fouling their Hand 14, (Yes, Step 124) then a Bonus Round begins at Step 200. If no players have a pair of Queens or better in their Front Row 16 or a player fouls their Hand 14, (No, Step 124) then the round of Open Face Poker Variation ends.

Figure 2:
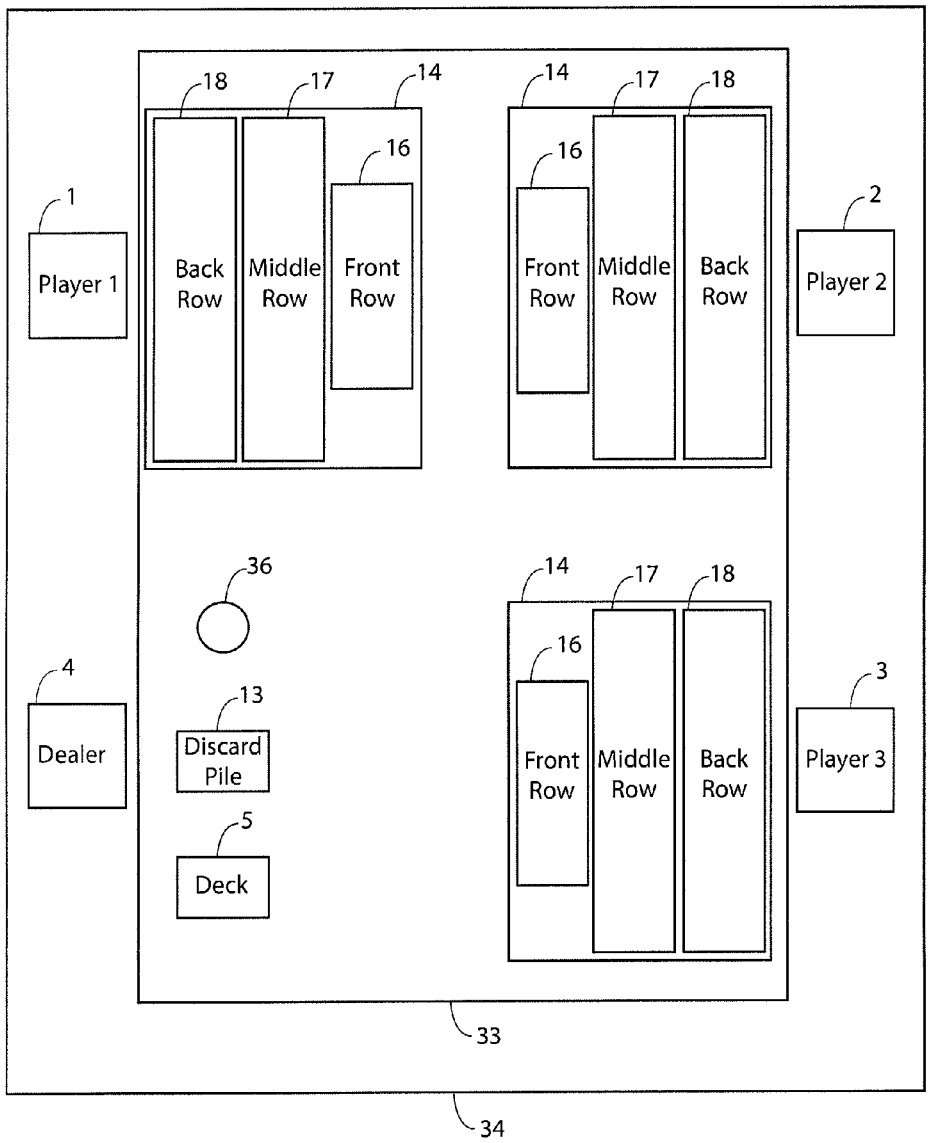
FIG. 2 is an entity relationship diagram of the Open Face Poker Variation according to the system and method of the present disclosure.

FIG. 2 is an entity relationship diagram of the Open Face Poker Variation according to the system and method of the present disclosure. In this aspect, standard poker hand rankings are used, and the player to the left of Dealer Button 36 is dealt cards first as described below. Dealer Button 36 is a marker used to indicate the player who is dealt cards first from Dealer 4 in casino games. In an amateur setting, where Dealer 4 may also be a participating player, Dealer Button 36 identifies the player who acts as Dealer 4 during that round, and is the last player to be dealt cards. To determine which player receives Dealer Button 36 prior to a game of Open Face Poker Variation, each of the players are dealt a single card from Deck 5. The player with High Card 22 receives Dealer Button 36, and thus may act last on that deal.

In Open Face Poker Variation, a maximum of three players may play at once, with the minimum being two players. A maximum number of players may be set due to the number of cards that are within a Deck 5 and how that number relates to the number of cards that may be dealt to players during Open Face Poker Variation (e.g. each player receives 17 cards using a fifty-two card deck, regardless of the number of players). Player 1, Player 2, and Player 3 may all receive up to 17 cards from within Deck 5 during a series of draws via Dealer 4 while playing Open Face Poker Variation.

Deck 5 may be the most common deck of 52 playing cards in use today, usually known as the French deck, and includes thirteen ranks of each of the four French suits, clubs, diamonds, hearts and spades, with reversible Rouennais "court" or face cards. Each suit includes an ace, depicting a single symbol of its suit; a king, queen, and jack, each depicted with a symbol of its suit; and ranks two through ten, with each card depicting that many symbols of its suit. As mentioned above, Dealer 4 may be one of the players participating in Open Face Poker Variation (e.g. in a home game) or a professional or amateur dealer of cards when Open Face Poker Variation is played at Poker Table 33 (e.g. in a casino game). The functions provided by Dealer 4 (e.g. shuffling and dealing cards, distributing points, wagers, royalties, chips and coins to the players) may also be incorporated into a software processor, located virtually within a network, or physically within Device 900 (shown in FIG. 8) that Open Face Poker Variation may be played on via Display 34. Players 1, 2 and 3 may be human (e.g. when playing at a Poker Table 33), or avatars (e.g. controlled by a computer or human using Device 35).

As shown in FIG. 2, Hand 14 may be a player's collection of 13 cards, separated into three rows (e.g. three cards+five cards+five cards) with four discards placed into Discard Pile 13. A row may be a collection of either three cards or five cards strategically organized to compete with other player's corresponding rows. A completed Hand 14 consists of a Front Row 16 containing three cards, a Middle Row 17 containing five cards and a Back Row 18 containing five cards. A Front Row 16 may only contain three cards, thus a player may only score a High Card, a Pair or a Three of a Kind within Front Row 16. The Middle Row 17 and Back Row 18 may contain five cards and any of the following ranks of rows such as a High Card, Pair, Three of a Kind, Straight, Flush, Full House, Four of a Kind, Straight Flush and Royal Flush may be played. In one aspect, once a card is organized within any of the rows open face, it may not be moved from one row to another row (e.g. Middle Row to Back Row).

Figure 3:
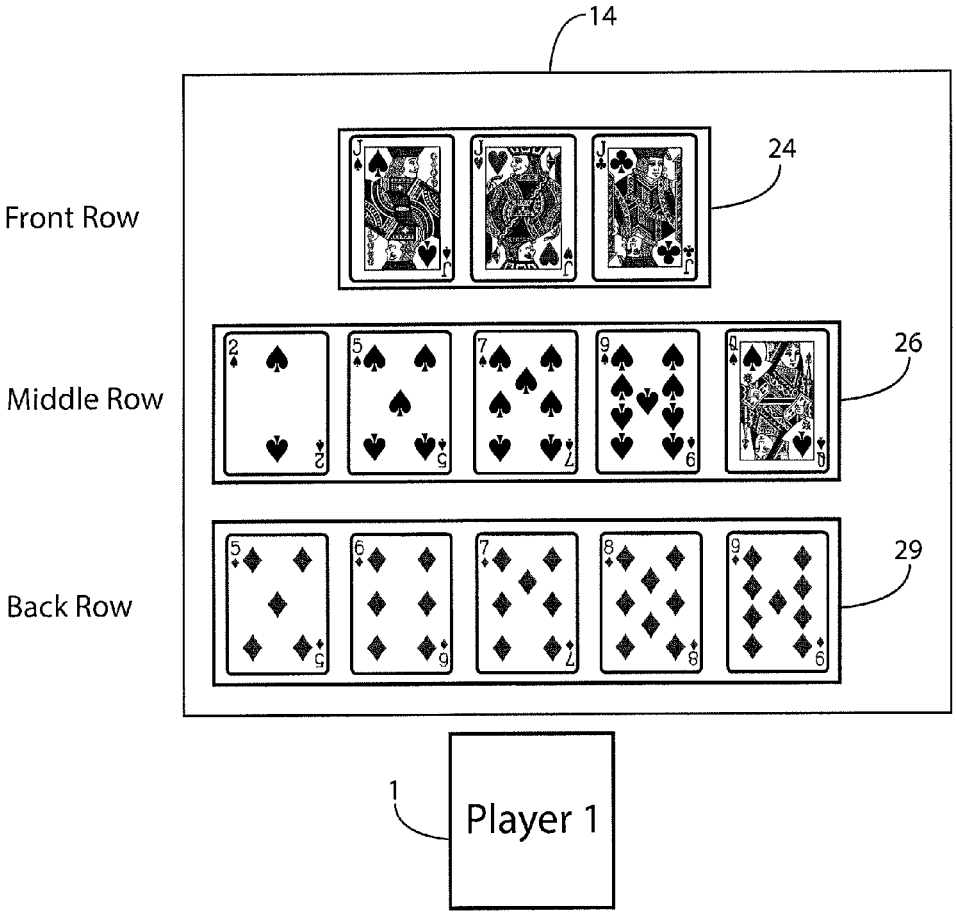
FIG. 3 is an example of Player 1's hand during a standard round of Open Face Poker Variation according to the system and method of the present disclosure.
Figure 4:
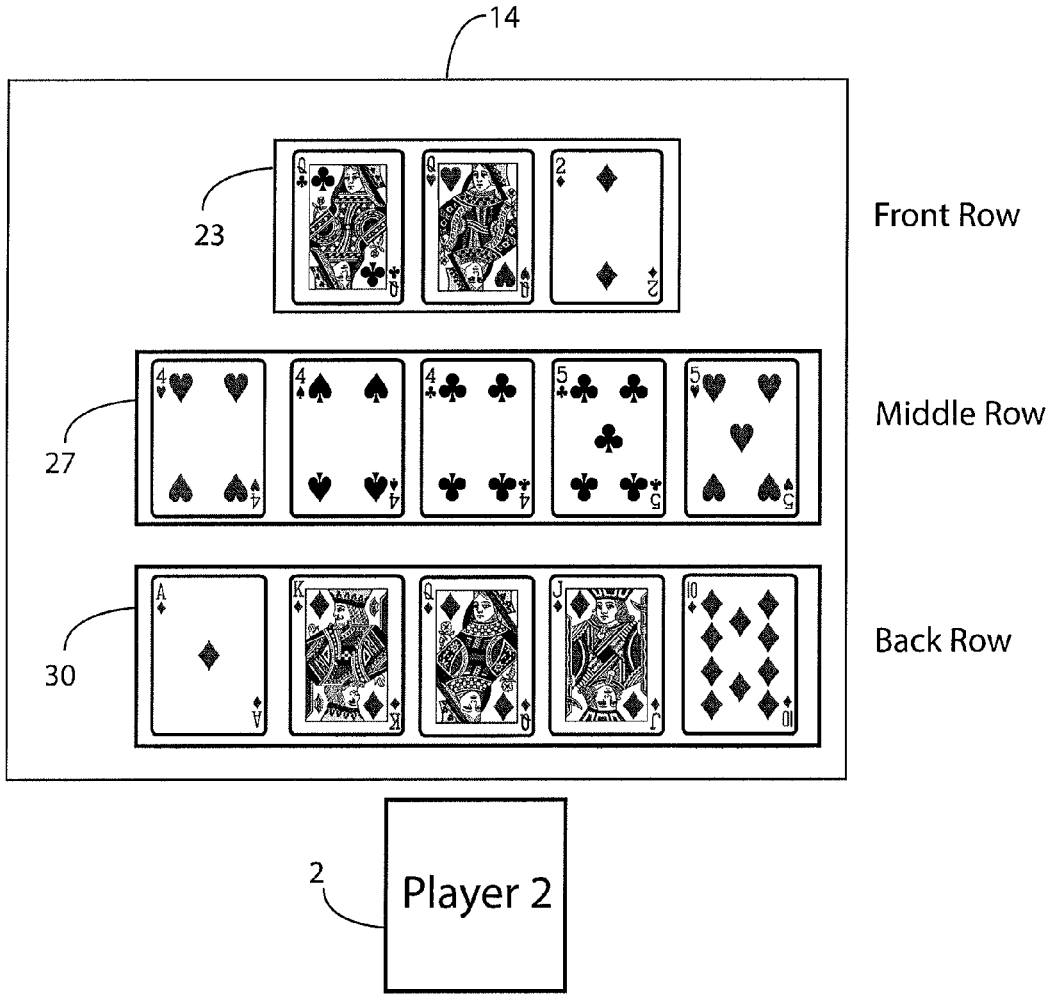
FIG. 4 is an example of Player 2's hand during a standard round of Open Face Poker Variation according to the system and method of the present disclosure.

FIG. 3 is an example of Player 1's hand and FIG. 4 is an example of Player 2's hand during a standard round of Open Face Poker Variation according to the system and method of the present disclosure. When Player 1 and Player 2 each have a completed Hand 14, (e.g. three cards in Front Row, five cards in Middle Row and five cards in Back Row) the rows within each Hand 14 are scored against the other player's corresponding rows. For example, the score associated with Player 1's Front Row 16, is compared against the score associated with Player 2's Front Row 16. If three players are participating in Open Face Poker Variation, Player would compare scores for each row, (e.g. Front Row, Middle Row, Back Row) with both Player 2 and Player 3, as if Player 1 were playing both Player 2 and Player 3 individually. Using standard poker rules, (e.g. pair beats high card) each row is compared to the corresponding row of other players.

Every row within Player 1's Hand 14 is individually compared to the corresponding row within Player 2's Hand 14. Points may be awarded to either player for having a better ranking corresponding row than the player they are competing against. For example, as shown in FIG. 3 and FIG. 4, the Three of a Kind 24 within the front row of Player 1's Hand 14 is better than the Pair 23 within the front row of Player 2's front row, and, as a result, Player 1 is awarded one point. Continuing the sequence, the Full House 27 in the middle row of Player 2's Hand 14 is better than the Flush 26 in the middle row of Player 1's Hand 14, as a result Player 2 is awarded one point. Finally, the Royal Flush 30 in the back row of Player 2's Hand 14 is better than the Straight Flush 29 in the back row of Player 1's Hand 14, as a result Player 2 is awarded one point. Points from each corresponding row are distributed and are accounted for in each player's score. Because each player scored one point, those points offset and thus do not count, but the second point awarded to Player 2 is counted, and deducted from Player 1 to give to Player 2 (e.g. Player 1 has −1 points, Player 2 has +1 points).

Points are distributed from one player to another (e.g. Player 1 gives one point to Player 2) after each round of Open Face Poker Variation has been completed. Players may play for money, and each point may be associated with a standard wager, (e.g. one point=$100) which may be set prior to a round of Open Face Poker Variation. An accumulation of points over one or more Rounds is referred to as a player's score, a player's score may be associated with each player (e.g. Player 1 may have a running tally of +20 points, giving them a score of 20). A player's score may continually be associated with a player as they play multiple rounds of Open Face Poker Variation.

Prior to starting a game of Open Face Poker Variation, each player may start with a score of zero. There may be no limit as to how much money can be gained or lost during a game of Open Face Poker Variation. If a player has a score with a negative value after the completion of a round or game of Open Face Poker Variation, they owe the other participating players the money associated with each point they have lost over the course of one or more rounds. Each player participates in a game of Open Face Poker Variation until they choose to stop, or they have exhausted all available funds.

Figure 5:
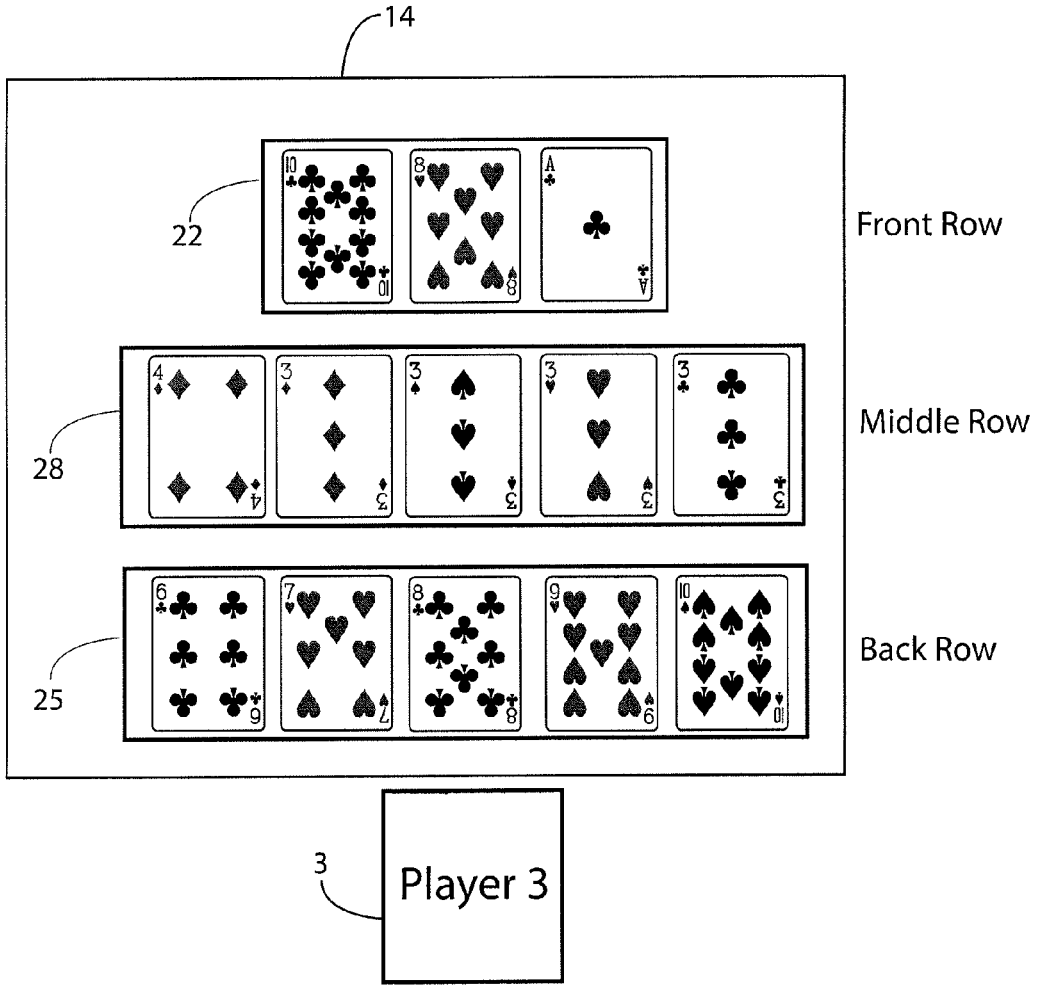
FIG. 5 is an example of Player 3's hand during a standard round of Open Face Poker Variation according to the system and method of the present disclosure.

FIG. 5 is an example of Player 3's hand during a standard round of the Open Face Poker Variation according to the system and method of the present disclosure. According to an aspect of the present disclosure, if a player does not properly organize their cards in the rows within their Hand 14 according to the present rules, then they commit a "foul" for the entire Hand 14. A "foul" occurs when a player has a front row that has a better rank than their middle row, or a middle row that has a better rank than their back row. In order to properly organize row strength within a Hand 14, the row rank of each player's Hand 14 should ascend from worst to best, Front Row 16 to Back Row 18. As shown in FIG. 5, Player 3 has a Four of a Kind 28 within the middle row and a Straight 25 within the back row. Player 3's Hand 14 resulted in a "foul" because the Four of a Kind 28 in the middle row is better than the Straight 25 in the back row. As a result, Player 3 forfeits their Hand 14, losing all three rows to both Player 1 and Player 2, thus giving six points to each player as described below. When a player loses all three rows, regardless of whether a foul occurs or not, it is called a "sweep." When a "sweep" occurs, the losing player distributes six points (e.g., two points per row in their hand) to each other player, (e.g., six points to Player 1 and six points to Player 2), resulting in a score of −12 associated with Player 3 for that individual round. Fouled hands are ineligible to enter Bonus Round. Players with fouled hands must still pay royalties due to other player in Bonus Round or regular rounds.

FIG. 6 is a table showing the scoring and royalty models of an aspect of the Open Face Poker Variation according to the system and method of the present disclosure. As shown in Step 122 of FIG. 1, corresponding rows are compared and scored once a round of Open Face Poker Variation is completed. As described in FIG. 3 and FIG. 4, players may receive points for having better corresponding rows than the players they are facing. A player may receive one point from every competing player for having a corresponding row with better rank. In another aspect of the present disclosure, depending on the rank of the winning player's individual rows, royalties may also be distributed to the winning player from the losing player. A royalty may be one or more points distributed to a player with a winning row, for having a row of a certain rank. Royalties are counted towards or against a players score in the same fashion as shown above in FIG. 3 and FIG. 4.

For example, Player 2 may have a back row with a better rank than Player 1's back row. As a result, Player 2 is awarded one point from Player 1 for having the better corresponding back row. Depending on the rank of the back row that Player 2 scored, Player 2 may also receive additional points from Player 1, which is known as a royalty. Using FIG. 3 and FIG. 4 for reference, Player 2 may have scored a row associated with a Royal Flush. As shown in FIG. 6, according to one or more scoring models used in the Open Face Poker Variation, scoring a Royal Flush within a back row may equate to a royalty which adds an additional 25 points to Player 2's score. Adding the 25 point royalty to the one point scored for having a better back row versus Player 1, Player 1 may owe Player 2 26 points. Only the winning row gets royalties. That is, Player 1 does not get royalties for the Straight Flush scored in the back row versus Player 2.

Royalties of varying amounts may be given to players for types of rows scored within Front Row 16, Middle Row 17 and Back Row 18, as shown in FIG. 6. For example, the chances of achieving a Pair within the front row are more likely than achieving a Three of a Kind within the front row. As a result, the royalty associated with a Three of a Kind within the front row equates to more points than the royalty associated with a Pair (e.g. Three of a Kind=20 points>Pair=1 to nine points).

Although scoring a Three of a Kind gives a player an additional 20 points in royalties when within the front row, scoring a Three of a Kind within the middle row gives a lower royalty. Because there are only three cards within a completed front row, the difficulty of creating a Three of a Kind within the front row increases, whereas there are five cards within a completed middle row. Therefore, scoring a Three of a Kind within middle row only warrants an additional two points to the winning player, and scoring a Pair within the middle row warrants no royalty. Scoring a Pair or a Three of a Kind may be easier to do within the middle and back row than in the front row, and decreases the players chances of their Hand 14 resulting in a foul.

In one aspect of the present disclosure, the middle row may issue the highest royalties for five card rows, because to receive the royalty associated with the middle row and avoid a "foul", the player's back row must have a better rank than their middle row. If the player's back row does not have a better rank than their middle row, then a foul may occur, resulting in no royalties earned by the player and a loss of points. In this aspect, as compared to the royalties associated with the back row, the royalties associated with the middle row may be worth twice as many points as the royalty associated with the back row because of the level of difficulty involved.

Referring FIG. 3, FIG. 4, and FIG. 5, Player 1's front row consisting of a Three of Kind (e.g. three Jacks) beats Player 2's front row of a pair (e.g. two Queens). As a result, Player 1 is awarded one point from Player 2 for winning the row, plus an additional 20 royalty points from Player 2 for having a Three of a Kind within the front row, for a total of 21 points from Player 2. Player 1's front row of a Three of Kind (e.g. three Jacks) beats Player 3's front row of a High Card (e.g.

Ace high), thus Player 1 is awarded a point as well as an additional 20 royalty points from Player 3 for having a Three of a Kind within their front row, for a total of 21 points. Player 2's front row is also stronger than Player 3's front row (e.g. Two Pair>High Card) resulting in one point given to Player 2 from Player 3 for winning the row. Player 3 may also distribute royalty points to Player 2 for the pair scored in their first row (e.g. seven points for pair of Queens). After scoring the front row, Player 1 has a score of 42 points (e.g. (1+20) taken from Player 2+(1+20) taken from Player 3=42 points). Player 2 has a score of −13 points (e.g. (−1−20) given to Player 1+(1+7) taken from Player 3=−13 points). Player 3 has a score of negative 29 points (e.g. (−1−20) given to Player 1+(−1−7) given to Player 2=−29 points). This method of scoring may be continued to address the middle row and back row of each Hand 14.

Figure 7:
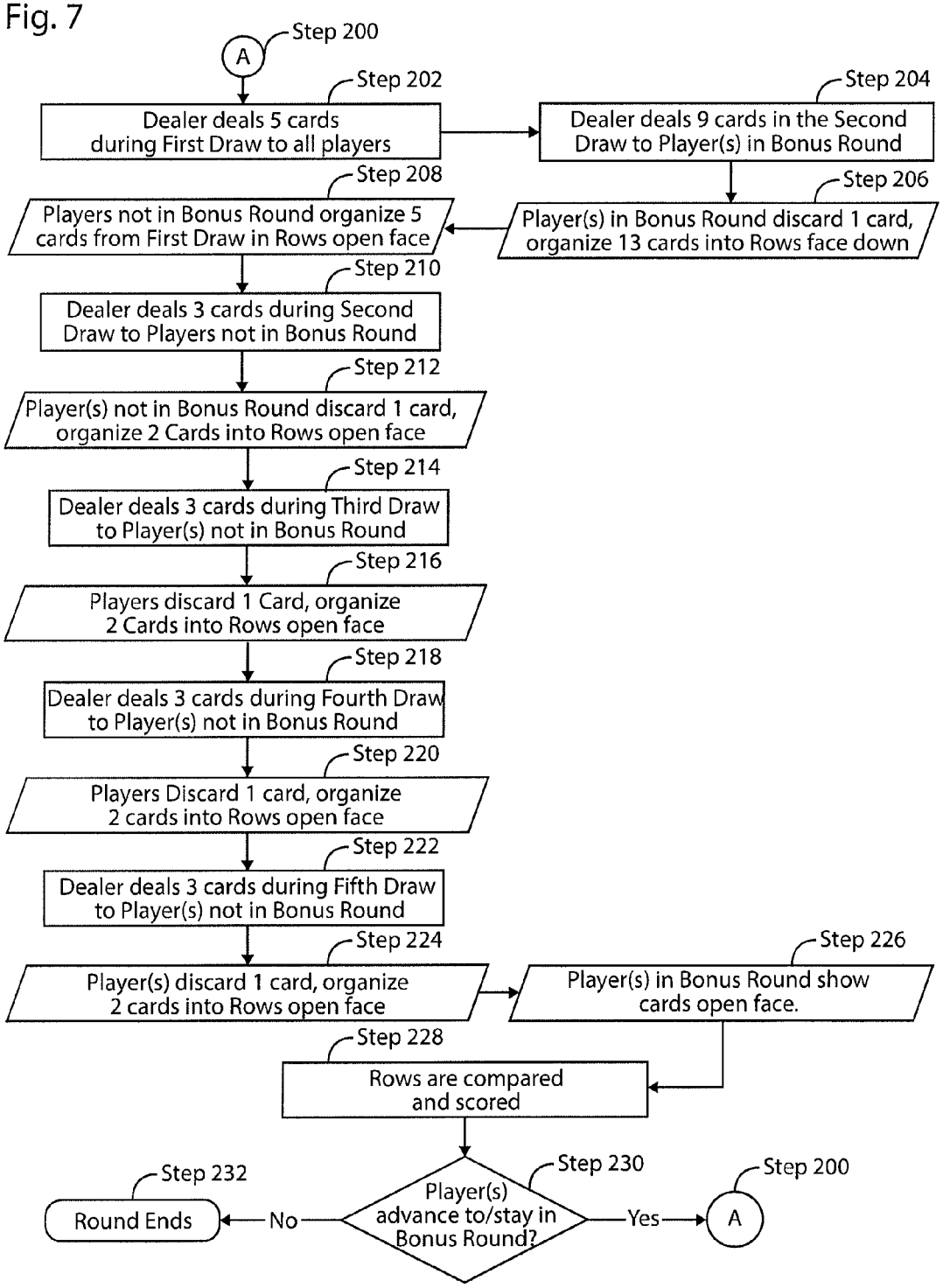
FIG. 7 is a process flow showing a round of the Open Face Poker Variation according to the system and method of the present disclosure.

FIG. 7 is a process flow describing a Bonus Round of the Open Face Poker Variation according to the system and method of the present disclosure. To participate in a Bonus Round of Open Face Poker Variation, the player must have a ranking of a pair of Queens or greater (e.g. Pair of Kings, Pair of Aces, Three of a Kind) in their Front Row 16 in the prior round. As shown in FIG. 1, when at least one player has a pair of Queens or higher in their Front Row 16, the player(s) will have a Bonus Round in the next round, beginning at Step 200.

At Step 202 of the Bonus Round, Dealer 4 deals five cards face down to all participating players during the First Draw. At Step 204, once each player has five cards, and prior to each player organizing said cards in any of their rows, Dealer 4 deals nine cards all at once to the player(s) participating in the Bonus Round. At Step 206 the player(s) participating in the Bonus Round organize 13 cards within any of their rows face down, and place one card within Discard Pile 13 face down so the other players do not see the value or suit of the discarded card. In one aspect of the present disclosure, the player(s) in the Bonus Round may indicate to the other players whether they will be in the Bonus Round during the next round, based on the cards they are dealt and place in their Hand 14 after Step 206. This disclosure may entice the player(s) not participating in the Bonus Round to play more aggressively to compete with the player(s) in the Bonus Round. At this point the player(s) participating in the Bonus Round have 13 cards organized face down in their Hand 14 (five cards from the First Draw+eight cards from the Second Draw). The player(s) not participating in the Bonus Round have five cards that have yet to be organized in any of their three rows (five cards from the First Draw).

At Step 208, the player(s) not participating in the Bonus Round organize their five cards from the First Draw into any of their rows open face. At Step 210, once all players not participating in the Bonus Round have organized their five cards in any of their rows from the First Draw, Dealer 4 deals the Second Draw to the player(s) not participating in the Bonus Round. The Second Draw consists of three cards dealt to each player not participating in the Bonus Round face down, with cards being dealt one by one to each player, starting with the player directly to the left of Dealer Button 36. At Step 212, once all players have three cards face down, each player organizes two of their three cards in any of their rows open face. Starting with the player directly to the left of Dealer Button 36, each player also places the third card within Discard Pile 13 face down, so the other players do not see the value or suit of the discarded card. At this point, the player(s) not participating in the Bonus Round have seven cards within their Hand 14, (five cards from the First Draw+two cards from the Second Draw) that are distributed in any of the player's three rows.

During Step 214, Dealer 4 deals the Third Draw to player (s) not participating in the Bonus Round. All players receive three cards face down. At Step 216, the player(s) not participating in the Bonus Round place one of the three cards face down within Discard Pile 13 so the other players do not see the value or suit of the discarded card, and organize the other two cards within any of their three rows open face. At this point, each player has nine cards (five cards from First Draw+two cards from Second Draw+two cards from Third Draw) that are organized in any of the player's three rows.

During Step 218. Dealer 4 deals the Fourth Draw to player (s) not participating in the Bonus Round. All players receive three cards face down. At Step 220, the player(s) then place one of the three cards face down within Discard Pile 13 so the other players do not see the value or suit of the discarded card, and organize the other two cards within any of their three rows open face. At this point, the player(s) not participating in the Bonus Round have 11 cards within their Hand 14, (five cards from the First Draw+two cards from the Second Draw+two cards from the Third Draw+two cards from the Fourth Draw) that are distributed in any of the player's three rows.

At Step 222 Dealer 4 deals the Fifth Draw to player(s) not participating in the Bonus Round. All players receive three cards face down. At Step 224 the players then place one of the three cards face down within Discard Pile 13 so the other players do not see the value or suit of the discarded card, and organize the other two cards within any of their three rows open face. At this point, each player has 13 cards (five cards from First Draw+two cards from Second Draw+two cards from Third Draw+two cards from Fourth Draw+two cards from the Fifth Draw) that are organized in any of the player's three rows.

At Step 226, once the player(s) not participating in the Bonus Round have organized their two cards in any of their rows from the Fifth Draw, the player(s) participating in the Bonus Round display their cards open face. At this point all players (e.g. players in Bonus Round and players in a standard round) have displayed their cards open face. During Step 228, the players and or Dealer 4 compare the strength of corresponding rows with the other player's corresponding rows (e.g. Player 1's Front Row vs. Player 2's Front Row, Player 1's Front Row vs. Player 3's Front Row, Player 2's Front Row vs. Player 3's Front Row, Player 1's Middle Row vs. Player 2's Middle Row, Player 1's Middle Row vs. Player 3's Middle Row, Player 2's Middle Row vs. Player 3's Middle Row, Player 1's Back Row vs. Player 2's Back Row, Player 1's Back Row vs. Player 3's Back Row, Player 2's Back Row vs. Player 3's Back Row). The players with the best ranking row for the Front Row 16, Middle Row 17 and Back Row 18 are awarded points, as well as any royalties for specific types of rows.

During Step 230, it is determined if any of the players participating in Open Face Poker Variation will enter or stay in the Bonus Round when the next round begins. If one or more players not currently participating in the Bonus Round have a pair of Queens or better in their Front Row 16, (Yes, Step 230) then a Bonus Round begins at Step 200. For the players currently participating in a Bonus Round, they must have a Three of a Kind 24 or better in the First Row 16, or a Straight Flush 29 or better in Back Row 18 to participate in another Bonus Round. If none of the players not participating in the Bonus Round have a pair of Queens or better in their Front Row 16, or none of the players participating in Bonus Round have a Three of a Kind 24 in Front Row 16 or Straight Flush 29 in Back Row 18, (No, Step 300), then the Bonus Round of Open Face Poker Variation ends at Step 232.

Figure 8:
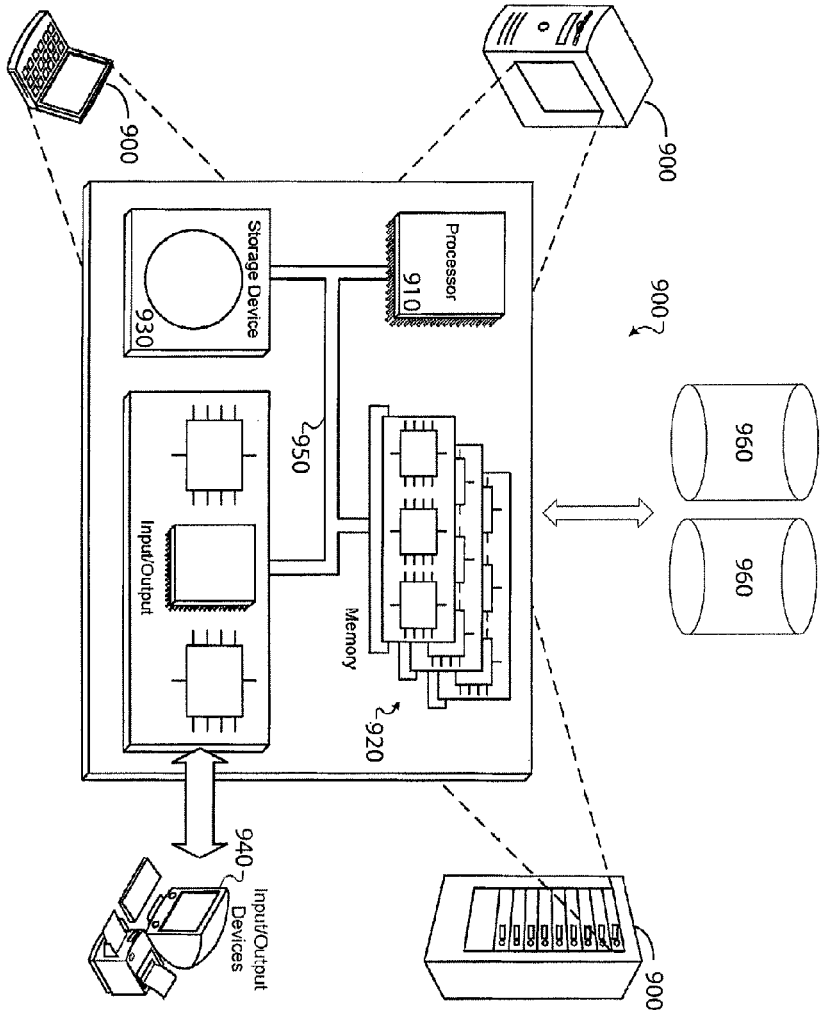
FIG. 8 is a diagram displaying a general purpose computer on which the system and method of the present disclosure may be implemented according to an aspect of present disclosure.

FIG. 8 shows a general purpose computer on which the system and method of the present disclosure may be implemented. The computer system 900 may execute at least some of the operations described above. Computer system 900 may include processor 910, memory 920, storage device 930, and input/output devices 940. Some or all of the components 910, 920, 930, and 940 may be interconnected via system bus 950. Processor 910 may be single or multi-threaded and may have one or more cores. Processor 910 may execute instructions, such as those stored in memory 920 or in storage device 930. Information may be received and output using one or more input/output devices 940.

Memory 920 may store information and may be a computer-readable medium, such as volatile or non-volatile memory. Storage device 930 may provide storage for system 900 and may be a computer-readable medium. In various aspects, storage device 930 may be a flash memory device, a floppy disk device, a hard disk device, an optical disk device, or a tape device.

Input/output devices 940 may provide input/output operations for system 900. Input/output devices 940 may include a keyboard, pointing device, and microphone. Input/output devices 940 may further include a display unit for displaying graphical user interfaces, speaker, and printer. External data, such as financial data, may be stored in accessible external databases 960.

The features described may be implemented in digital electronic circuitry, or in computer hardware, firmware, software, or in combinations thereof. The apparatus may be implemented in a computer program product tangibly embodied in an information carrier, e.g., in a machine-readable storage device or in a propagated signal, for execution by a programmable processor; and method steps may be performed by a programmable processor executing a program of instructions to perform functions of the described implementations by operating on input data and generating output.

The described features may be implemented in one or more computer programs that are executable on a programmable system including at least one programmable processor coupled to receive data and instructions from, and to transmit data and instructions to, a data storage system, at least one input device, and at least one output device. A computer program may include set of instructions that may be used, directly or indirectly, in a computer to perform a certain activity or bring about a certain result. A computer program may be written in any form of programming language, including compiled or interpreted languages, and it may be deployed in any form, including as a stand-alone program or as a module, component, subroutine, or other unit suitable for use in a computing environment.

Suitable processors for the execution of a program of instructions may include, by way of example, both general and special purpose microprocessors, and the sole processor or one of multiple processors of any kind of computer. Generally, a processor may receive instructions and data from a read only memory or a random access memory or both. Such a computer may include a processor for executing instructions and one or more memories for storing instructions and data. Generally, a computer may also include, or be operatively coupled to communicate with, one or more mass storage devices for storing data files; such devices include magnetic disks, such as internal hard disks and removable, disks; magneto-optical disks; and optical disks. Storage devices suitable for tangibly embodying computer program instructions and data may include all forms of non-volatile memory, including by way of example semiconductor memory devices, such as EPROM, EEPROM, and flash memory devices; magnetic disks such as internal hard disks and removable disks; magneto-optical disks; and CD-ROM and DVD-ROM disks. The processor and the memory may be supplemented by, or incorporated in, ASICs (application-specific integrated circuits).

To provide for interaction with a user, the features may be implemented on a computer having a display device such as a CRT (cathode ray tube) or LCD (liquid crystal display) monitor for displaying information to the user and a keyboard and a pointing device such as a mouse or a trackball by which the user may provide input to the computer.

The features may be implemented in a computer system that includes a back-end component, such as a data server, or that includes a middleware component, such as an application server or an Internet server, or that includes a front-end component, such as a client computer having a graphical user interface or an Internet browser, or any combination of them. The components of the system may be connected by any form or medium of digital data communication such as a communication network. Examples of communication networks may include, e.g., a LAN, a WAN, and the computers and networks forming the Internet.

The computer system may include clients and servers. A client and server may be remote from each other and interact through a network, such as the described one. The relationship of client and server may arise by virtue of computer programs running on the respective computers and having a client-server relationship to each other.

Numerous additional modifications and variations of the present disclosure are possible in view of the above teachings. It is therefore to be understood that within the scope of the appended claims, the present disclosure may be practiced other than as specifically described herein.

The invention claimed is:

1. A programmed computer for executing a poker game, comprising:

a memory having at least one region for storing computer executable program code; and a processor executing the program code stored in the memory, wherein the program code comprises:

a) transmitting, at a beginning of a first round during which no players are receiving bonus treatment, a first draw of a predetermined number of cards to two or more players such that the suit and rank of cards for one player are not visible to another player;

b) receiving from each player a location of each card from the first draw in one of three rows for each player, the first row holding a maximum of three cards, and the second and third rows each holding a maximum of five cards;

c) displaying the cards from the first draw such that the suit and rank of cards and card locations for one player are visible to another player;

d) transmitting a second draw of a predetermined number of cards to the two or more players such that the suit and rank of cards for one player are not visible to another player;

e) receiving from each player a discarded card from the second draw and receiving from each player the location of each remaining card from the second draw in one of the three rows;

f) displaying the cards from the second draw such that the suit and rank of cards and card locations for one player are visible to another player;

g) repeating steps d), e), and f) for third, fourth, and fifth draws;

h) comparing the corresponding rows of each player and generating a score for each player; and i) determining, during the first round, whether any player is eligible for bonus treatment to be applied in a second round.

2. The programmed computer for executing a poker game of claim 1, wherein the maximum number of players is three, the first draw includes five cards, and each of the second, third, fourth, and fifth draws include three cards.

3. The programmed computer for executing a poker game of claim 1, wherein i) determining, during the first round, whether any player is eligible for bonus treatment to be applied in the second round, further comprises:

deeming a player eligible for bonus treatment to be applied in the second round when the player has a predetermined hand or higher in the first row.

4. The programmed computer for executing a poker game of claim 3, wherein the predetermined hand is a pair of queens.

5. The programmed computer for executing a poker game of claim 1, wherein h) comparing the corresponding rows of each player and generating a score for each player comprises:

adding a predetermined number of units to the winning player's score and subtracting the predetermined number units from another player's score when each of a winning player's three rows are better than each of three corresponding rows of the other player.

6. The programmed computer for executing a poker game of claim 5, wherein the predetermined number of units is 6.

7. The programmed computer for executing a poker game of claim 1, further comprising code used during the second round when one or more players are receiving bonus treatment comprising:

aa) transmitting a first bonus draw of a predetermined number of cards to all players such that the suit and rank of cards for one player are not visible to another player;

ab) transmitting a first supplemental bonus draw of a predetermined number of cards to players receiving bonus treatment in the second round such that the suit and rank of cards for one player are not visible to another player;

ac) receiving from each player receiving bonus treatment in the second round a location of each card from the first bonus draw and first supplemental bonus draw in one of three rows for each player, the first row holding three cards, and the second and third rows each holding five cards, and receiving from each player receiving bonus treatment in the second round a discarded card;

ad) determining whether any player receiving bonus treatment in the second round is eligible for bonus treatment to be applied in a third round;

ae) receiving from each player not receiving bonus treatment in the second round a location of each card from the first bonus draw in one of three rows for each player, the first row holding a maximum of three cards, and the second and third rows each holding a maximum of five cards;

at) displaying the cards from the first bonus draw for each player not receiving bonus treatment in the second round such that the suit and rank of cards and card locations for one player are visible to another player;

ag) transmitting a second bonus draw of a predetermined number of cards to each player not receiving bonus treatment in the second round such that the suit and rank of cards for one player are not visible to another player;

ah) receiving from each player not receiving bonus treatment in the second round a discarded card from the second bonus draw and receiving from each player not receiving bonus treatment in the second round the location of each remaining card from the second bonus draw in one of the three rows;

ai) displaying the cards from the second bonus draw from each player not receiving bonus treatment in the second round such that the suit and rank of cards and card locations for one player are visible to another player;

aj) repeating steps ag), ah), and ai) for third, fourth, and fifth bonus draws;

ak) displaying the cards for each player receiving bonus treatment in the second round such that the suit and rank of cards and card locations for one player are visible to another player;

al) comparing the corresponding rows of each player and generating a score for each player; and am) determining whether any player not receiving bonus treatment in the second round is eligible for bonus treatment to be applied in a third round.

8. The programmed computer for executing a poker game of claim 7, wherein the first bonus draw includes five cards, the first supplemental bonus draw includes nine cards, and each of the second, third, fourth, and fifth bonus draws include three cards.

9. The programmed computer for executing a poker game of claim 7, wherein ad) determining further comprises deeming a player currently receiving bonus treatment in the second round eligible for bonus treatment to be applied in the third round when the player has three of a kind or better in the first row or a straight flush or better in the third row; and am) determining further comprises deeming a player currently not receiving bonus treatment in the second round eligible for bonus treatment to be applied in the third round when the player has a pair of queens or higher in the first row.

10. The programmed computer for executing a poker game of claim 7, wherein:

ad) determining further comprises notifying other players that a player currently receiving bonus treatment in the second round will receive bonus treatment to be applied in the third round.

11. The programmed computer for executing a poker game of claim 1, further comprising:

adding to or subtracting from a player's aggregate score based on the score generated at the end of the round.

* * * * *